US009568853B2

(12) United States Patent
Yamazaki

(10) Patent No.: US 9,568,853 B2
(45) Date of Patent: Feb. 14, 2017

(54) IMAGE FORMING APPARATUS INCLUDING A PLURALITY OF DRIVER IC CONFIGURED TO DRIVE A PLURALITY OF LIGHT-EMITTING POINTS

(71) Applicant: CANON KABUSHIKI KAISHA, Tokyo (JP)

(72) Inventor: Katsuyuki Yamazaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/311,514

(22) Filed: Jun. 23, 2014

(65) Prior Publication Data

US 2014/0375744 A1 Dec. 25, 2014

(30) Foreign Application Priority Data

Jun. 24, 2013 (WO) ..... PCT/JP2013/067218

(51) Int. Cl.
*B41J 2/435* (2006.01)
*G03G 15/043* (2006.01)

(52) U.S. Cl.
CPC ..... *G03G 15/043* (2013.01)

(58) Field of Classification Search
USPC ..... 347/236, 237, 246, 247
See application file for complete search history.

(56) References Cited

U.S. PATENT DOCUMENTS

| | | | | |
|---|---|---|---|---|
| 7,136,086 | B2 * | 11/2006 | Omae | 347/237 |
| 2009/0016394 | A1 * | 1/2009 | Kanno | 372/38.02 |
| 2011/0182603 | A1 * | 7/2011 | Kawamoto | 399/51 |

FOREIGN PATENT DOCUMENTS

| | | | | |
|---|---|---|---|---|
| JP | 2004-106419 A | | 4/2004 | |
| JP | 2004106419 A | * | 4/2004 | B41J 2/44 |
| JP | 2007-203543 A | | 8/2007 | |
| JP | 2008-233562 A | | 10/2008 | |
| JP | 2011-207213 A | | 10/2011 | |

* cited by examiner

*Primary Examiner* — Matthew Luu
*Assistant Examiner* — Tracey McMillion
(74) *Attorney, Agent, or Firm* — Canon USA, Inc. IP Division

(57) ABSTRACT

In APC, if light power control with different target light powers is continuously executed, the amplitude of an output signal from a light-receiving element after the light power control is changed is generated, and a long time is required for completion of the light power control after the change. To address the problem, light power control with the same target light power is continuously executed on at least two light-emitting points in APC.

1 Claim, 11 Drawing Sheets

FIG. 7A

| | DIS | APCH | | APCM | | APCL | | ACC1 | | VDO | OFF |
|---|---|---|---|---|---|---|---|---|---|---|---|
| Isw | OFF | ON | OFF | ON | OFF | ON | OFF | ON | OFF | ON | OFF |
| Ib | OFF | ON | ON | ON | ON | ON | ON | ON | ON | ON | ON |
| ms3 | L | L | L | L | L | L | L | H | H | H | [1] |
| ms2 | L | L | L | L | L | H | H | L | L | H | [1] |
| ms1 | L | L | L | H | H | L | L | L | L | H | [1] |
| ms0 | L | H | H | L | L | L | L | H | H | H | [1] |
| ic | [*] | L | H | L | H | L | H | L | H | [*] | [*] |
| ch3 | [*] | [2] | [*] | [2] | [*] | [2] | [*] | [2] | [*] | [*] | [*] |
| ch2 | [*] | [2] | [*] | [2] | [*] | [2] | [*] | [2] | [*] | [*] | [*] |
| ch1 | [*] | [2] | [*] | [2] | [*] | [2] | [*] | [2] | [*] | [*] | [*] |
| ch0 | [*] | [2] | [*] | [2] | [*] | [2] | [*] | [2] | [*] | [*] | [*] |

FIG. 7B

| | e1 | e2 | e3 | e4 | e5 | e6 | e7 | e8 | e9 | e10 | e11 | e12 | e13 | e14 | e15 | e16 |
|---|---|---|---|---|---|---|---|---|---|---|---|---|---|---|---|---|
| ch3 | L | L | L | L | L | L | L | L | H | H | H | H | H | H | H | H |
| ch2 | L | L | L | L | H | H | H | H | L | L | L | L | H | H | H | H |
| ch1 | L | L | H | H | L | L | H | H | L | L | H | H | L | L | H | H |
| ch0 | L | H | L | H | L | H | L | H | L | H | L | H | L | H | L | H |

FIG. 8A

| | 1 | 2 | 3 | 4 | 5 | 6 | 7 | 8 |
|---|---|---|---|---|---|---|---|---|
| N | H1 | H2 | H4 | H3 | H7 | H8 | H6 | H5 |
| N+1 | M1 | M2 | M4 | M3 | M7 | M8 | M6 | M5 |
| N+2 | L1 | L2 | L4 | L3 | L7 | L8 | L6 | L5 |
| N+3 | H9 | H10 | H12 | H11 | H15 | H16 | H14 | H13 |
| N+4 | M9 | M10 | M12 | M11 | M15 | M16 | M14 | M13 |
| N+5 | L9 | L10 | L12 | L11 | L15 | L16 | L14 | L13 |
| N+6 | H17 | H18 | H20 | H19 | H23 | H24 | H22 | H21 |
| N+7 | M17 | M18 | M20 | M19 | M23 | M24 | M22 | M21 |
| N+8 | L17 | L18 | L20 | L19 | L23 | L24 | L22 | L21 |
| N+9 | H25 | H26 | H28 | H27 | H31 | H32 | H30 | H29 |
| N+10 | M25 | M26 | M28 | M27 | M31 | M32 | M30 | M29 |
| N+11 | L25 | L26 | L28 | L27 | L31 | L32 | L30 | L29 |

FIG. 8B

| | 1 | 2 | 3 | 4 |
|---|---|---|---|---|
| N | H1 | H2 | H4 | H3 |
| N+1 | M1 | M2 | M4 | M3 |
| N+2 | L1 | L2 | L4 | L3 |
| N+3 | H5 | H6 | H8 | H7 |
| N+4 | M5 | M6 | M8 | M7 |
| N+5 | L5 | L6 | L8 | L7 |
| N+6 | H9 | H10 | H12 | H11 |
| N+7 | M9 | M10 | M12 | M11 |
| N+8 | L9 | L10 | L12 | L11 |
| N+9 | H13 | H14 | H16 | H15 |
| N+10 | M13 | M14 | M16 | M15 |
| N+11 | L13 | L14 | L16 | L15 |
| N+12 | H17 | H18 | H20 | H19 |
| N+13 | M17 | M18 | M20 | M19 |
| N+14 | L17 | L18 | L20 | L19 |
| N+15 | H21 | H22 | H24 | H23 |
| N+16 | M21 | M22 | M24 | M23 |
| N+17 | L21 | L22 | L24 | L23 |
| N+18 | H25 | H26 | H28 | H27 |
| N+19 | M25 | M26 | M28 | M27 |
| N+20 | L25 | L26 | L28 | L27 |
| N+21 | H29 | H30 | H32 | H31 |
| N+22 | M29 | M30 | M32 | M31 |
| N+23 | M29 | L30 | L23 | L31 |

FIG. 8C

| | 1 | 2 | 3 |
|---|---|---|---|
| N | H2 | H1 | H3 |
| N+1 | M2 | M1 | M3 |
| N+2 | L2 | L1 | L3 |
| N+3 | H6 | H5 | H7 |
| N+4 | M6 | M5 | M7 |
| N+5 | L6 | L5 | L7 |
| N+6 | H10 | H9 | H11 |
| N+7 | M10 | M9 | M11 |
| N+8 | L10 | L9 | L11 |
| N+9 | H14 | H13 | H15 |
| N+10 | M14 | M13 | M15 |
| N+11 | L14 | L13 | L15 |
| N+12 | H18 | H17 | H19 |
| N+13 | M18 | M17 | M19 |
| N+14 | L18 | L17 | L19 |
| N+15 | H22 | H21 | H23 |
| N+16 | M22 | M21 | M23 |
| N+17 | L22 | L21 | L23 |
| N+18 | H26 | H25 | H27 |
| N+19 | M26 | M25 | M27 |
| N+20 | L26 | L25 | L27 |
| N+21 | H30 | H29 | H31 |
| N+22 | M30 | M29 | M31 |
| N+23 | L30 | L29 | L31 |
| N+24 | H4 | H20 | H18 |
| N+25 | M4 | M20 | M18 |
| N+26 | L4 | L20 | L18 |
| N+27 | H8 | H24 | H22 |
| N+28 | M8 | M24 | M22 |
| N+29 | L8 | L24 | L22 |
| N+30 | H12 | H28 | H26 |
| N+31 | M12 | M28 | M26 |
| N+32 | L12 | L28 | L26 |
| N+33 | H16 | H32 | H30 |
| N+34 | M16 | M32 | M30 |
| N+35 | L16 | L32 | L30 |

FIG. 8D

| | 1 | 2 |
|---|---|---|
| N | H1 | H2 |
| N+1 | M1 | M2 |
| N+2 | L1 | L2 |
| N+3 | H3 | H4 |
| N+4 | M3 | M4 |
| N+5 | L3 | L4 |
| N+6 | H5 | H6 |
| N+7 | M5 | M6 |
| N+8 | L5 | L6 |
| N+9 | H7 | H8 |
| N+10 | M7 | M8 |
| N+11 | L7 | L8 |
| N+12 | H9 | H10 |
| N+13 | M9 | M10 |
| N+14 | L9 | L10 |
| N+15 | H11 | H12 |
| N+16 | M11 | M12 |
| N+17 | L11 | L12 |
| N+18 | H13 | H14 |
| N+19 | M13 | M14 |
| N+20 | L13 | L14 |
| N+21 | H15 | H16 |
| N+22 | M15 | M16 |
| N+23 | L15 | L16 |
| N+24 | H17 | H18 |
| N+25 | M17 | M18 |
| N+26 | L17 | L18 |
| N+27 | H19 | H20 |
| N+28 | M19 | M20 |
| N+29 | L19 | L20 |
| N+30 | H21 | H22 |
| N+31 | M21 | M22 |
| N+32 | L21 | L22 |
| N+33 | H23 | H24 |
| N+34 | M23 | M24 |
| N+35 | L23 | L24 |
| N+36 | H25 | H26 |
| N+37 | M25 | M26 |
| N+38 | L25 | L26 |
| N+39 | H27 | H28 |
| N+40 | M27 | M28 |
| N+41 | L27 | L28 |
| N+42 | H29 | H30 |
| N+43 | M29 | M30 |
| N+44 | L29 | L30 |
| N+45 | H31 | H32 |
| N+46 | M31 | M32 |
| N+47 | L31 | L32 |

IMAGE FORMING APPARATUS INCLUDING A PLURALITY OF DRIVER IC CONFIGURED TO DRIVE A PLURALITY OF LIGHT-EMITTING POINTS

TECHNICAL FIELD

The present disclosure relates to a light power control method of a light source included in an electrophotographic image forming apparatus.

BACKGROUND ART

In recent years, an electrophotographic image forming apparatus forms an image by exposing a photosensitive member to light with a plurality of rays of laser light to meet the demand of an increase in speed of image formation.

The electrophotographic image forming apparatus supplies bias current to each of a plurality of light-emitting points of the light source to ensure emission response of laser light (light beam) with which the photosensitive member is exposed to light. Since the plurality of light-emitting points each have a unique emission characteristic (relationship between current and light power), the value of bias current is set for each of the plurality of light-emitting points. Since the emission characteristic of each light-emitting point varies depending on the temperature of the light source, the image forming apparatus executes light power control on each light-emitting point during a period in which laser light does not scan on the photosensitive member when the image forming apparatus executes image formation on a recording medium.

PTL 1 discloses an image forming apparatus that executes first light power control (APC-H in PTL 1) and second light power control (APC-L in PTL 1) on each of a plurality of light-emitting points, and hence controls the value of bias current, which is supplied to each of the plurality of light-emitting points, based on the result of the first light power control and the result of the second light power control. The image forming apparatus described in PTL 1 controls the value of current, which is supplied to each light-emitting point, in the first light power control so that the light power of laser light, which is emitted from each light-emitting point, becomes a first light power, and controls the value of current, which is supplied to each light-emitting point, in the second light power control immediately after the first light power control so that the light power of laser light, which is emitted from each light-emitting point, becomes a second light power. The image forming apparatus of PTL 1 continuously executes the first light power control and the second light power control on a single light-emitting point, and then executes the first light power control and the second light power control similarly on another light-emitting point. Thus, the image forming apparatus of PTL 1 executes the first light power control and the second light power control on all light-emitting points.

PATENT LITERATURE

PTL 1 Japanese Patent Laid-Open No. 2011-207213

However, as shown in FIGS. 11A and 11B, if the first light power control and the second light power control with different target light powers are continuously executed, the amplitude of an output signal from a light-receiving element after the light power control is changed is generated, and a long time is required for completion of the light power control after the change. Owing to this, the number of light-emitting points on which the light power control can be executed within a single scanning period is decreased, and the frequency of execution of the light power control on each light-emitting point is decreased.

SUMMARY

To address the above-described problems, an image forming apparatus according to the invention of this application includes a light source including a plurality of light-emitting points that emit light beams for exposing a photosensitive member; a light-receiving unit configured to receive the plurality of light beams emitted from the plurality of light-emitting points; a light power control unit configured to execute first light power control controlling driving current supplied to each of the plurality of light-emitting points, so that a light power of the light beams received by the light-receiving unit becomes a first light power, and second light power control controlling driving current supplied to each of the plurality of light-emitting points, so that the light power of the light beams received by the light-receiving unit becomes a second light power; and a bias current control unit configured to control a value of bias current supplied to each of the plurality of light-emitting points based on results of the first light power control and the second light power control by the light power control unit.

The light power control unit is configured to execute the first light power control and the second light power control on the plurality of light-emitting points at different timings and continuously executes the first light power control on at least two or more light-emitting points among the plurality of light-emitting points.

Further features of the present invention will become apparent from the following description of exemplary embodiments with reference to the attached drawings.

BRIEF DESCRIPTION OF DRAWINGS

FIGS. 7A and 7B are illustrations each showing a control mode.

FIGS. 8A to 8D are illustrations each explaining an execution order of light power control.

DESCRIPTION OF EMBODIMENTS

First Embodiment

Image Forming Apparatus

Figure 1:
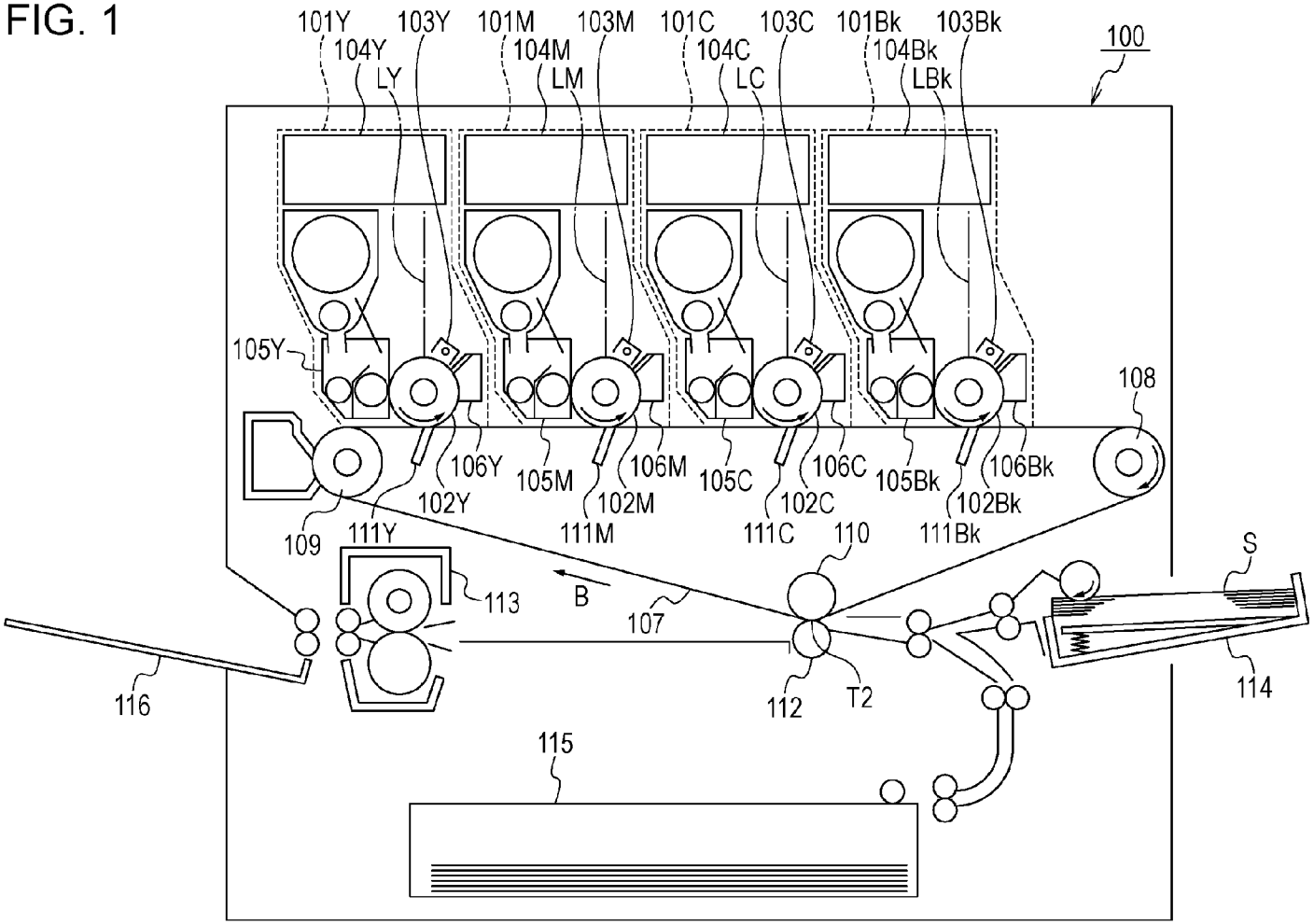
FIG. 1 is a schematic cross-sectional view of an image forming apparatus according to this embodiment.

An embodiment of, for example, an electrophotographic color image forming apparatus is described below. FIG. 1 is a schematic cross-sectional view of the color image forming apparatus. The image forming apparatus shown in FIG. 1 is a full-color printer that forms an image by using a plurality of colors of toners. In the following description, the full-color printer is described as an example of an image forming apparatus. However, other image forming apparatus, for example, a monochrome printer that forms an image by using a monochrome toner (for example, black), or a color or monochrome copier including a reading device may be employed.

In FIG. 1, the image forming apparatus includes image forming units 101Y, 101M, 101C, and 101Bk that form images of respective colors. Herein, the image forming units 101Y, 101M, 101C, and 101Bk form images by using respective toners of yellow (Y), magenta (M), cyan (C), and black (Bk).

The image forming units 101Y, 101M, 101C, and 101Bk respectively include photosensitive drums 102Y, 102M, 102C, and 102Bk each serving as a photosensitive member. Charging devices 103Y, 103M, 103C, and 103Bk, optical scanning devices 104Y, 104M, 104C, and 104Bk, and developing devices 105Y, 105M, 105C, and 105Bk are respectively arranged around the photosensitive drums 102Y, 102M, 102C, and 102Bk.

Further, drum cleaning devices 106Y, 106M, 106C, and 106Bk are respectively arranged around the photosensitive drums 102Y, 102M, 102C, and 102Bk.

An endless intermediate transfer belt 107 (intermediate transfer member) is arranged below the photosensitive drums 102Y, 102M, 102C, and 102Bk. The intermediate transfer belt 107 is supported with tension by a driving roller 108, a driven roller 109, and a driven member 110, and is rotationally driven in a direction indicated by arrow B in FIG. 1 during image formation. Also, primary transfer devices 111Y, 111M, 111C, and 111Bk are arranged at respective positions facing the photosensitive drums 102Y, 102M, 102C, and 102Bk through the intermediate transfer belt 107.

Also, the image forming apparatus 100 includes a secondary transfer device 112 that transfers toner images on the intermediate transfer belt 107 on a recording medium S, and a fixing device 113 that fixes the toner images on the recording medium S to the recording medium S.

An image forming process of the illustrated image forming apparatus 100 is described next. Image forming processes of the image forming units 101Y, 101M, 101C, and 101Bk are the same. Hence, for example, the image forming process of the image forming unit 101Y is described, and the description for the image forming processes of the image forming units 101M, 101C, and 101Bk is omitted.

First, the surface of the photosensitive drum 102Y, which is rotationally driven in a rotation direction indicated by a solid-line arrow in FIG. 1, is uniformly charged with electricity by the charging device 103Y. The charged photosensitive drum 102Y is exposed to laser light LY (light beam) emitted from the optical scanning device 104Y. Accordingly, an electrostatic latent image is formed on the photosensitive drum 102Y. Then, the electrostatic latent image is developed by the developing device 105Y, and becomes a yellow toner image.

The primary transfer devices 111Y, 111M, 111C, and 111Bk apply a transfer bias to the intermediate transfer belt 107. Accordingly, yellow, magenta, cyan, and black toner images on the photosensitive drums 102Y, 102M, 102C, and 102Bk are transferred on the intermediate transfer belt 107. Consequently, a color toner image is formed on the intermediate transfer belt 107.

The color toner image on the intermediate transfer belt 107 is transferred on a recording medium S by the secondary transfer device 112, the recording medium S which is conveyed from a manual paper feed cassette 114 or a paper feed cassette 115 to a secondary transfer portion T2. Then, the color toner image on the recording medium S is heated and fixed by the fixing device 113, and the recording medium S is ejected to a paper eject portion 116.

Residual toners, which are not transferred on the intermediate transfer belt 107 and remain on the photosensitive drums 102Y, 102M, 102C, and 102Bk, are respectively removed by the drum cleaning devices 106Y, 106M, 106C, and 106Bk. Then, the above-described image forming process is executed again.

Optical Scanning Device

Figure 2:
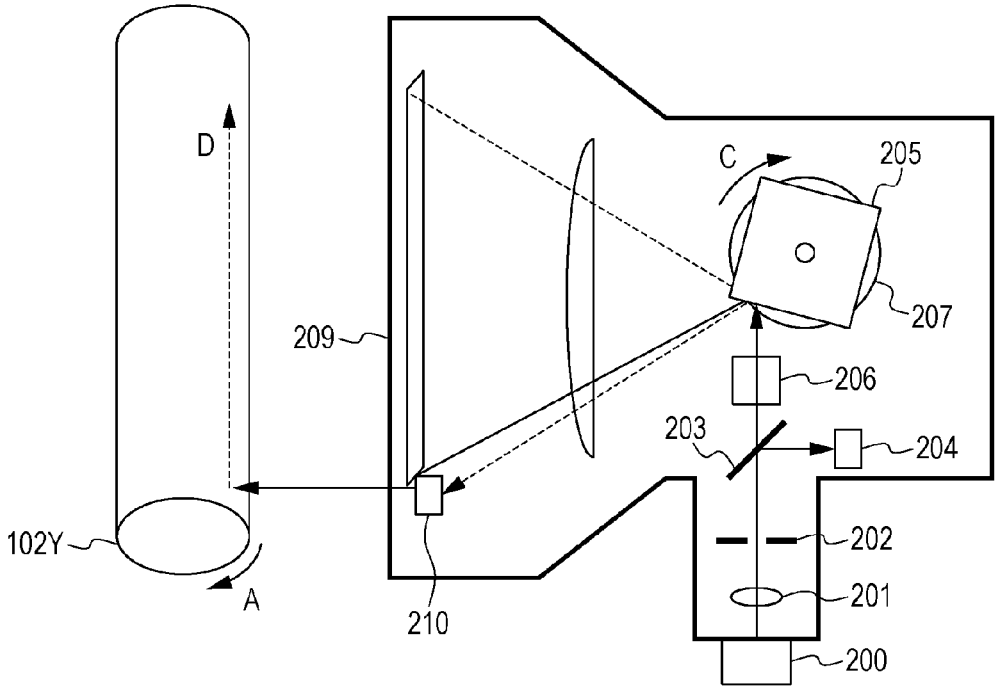
FIG. 2 is a schematic configuration diagram of an optical scanning device according to this embodiment.

FIG. 2 is a schematic configuration diagram of the optical scanning devices 104Y, 104M, 104C, and 104Bk. The respective optical scanning devices have the same configuration, and hence FIG. 2 shows, for example, the optical scanning device 104Y. In FIG. 2, laser light, which is emitted from a semiconductor laser 200 and is diverging, is collimated by a collimator lens 201 into substantially parallel light, and is shaped by limiting the passage of laser light by an aperture stop 202. The laser light, which has passed through the aperture stop 202, is incident on a beam splitter 203. The beam splitter 203 splits the laser light, which has passed through the aperture stop 202, into laser light, which is incident on a photodiode 204 (light-receiving unit, hereinafter, PD 204), and laser light, which is directed to a rotatable polygonal mirror 205 (hereinafter, polygonal mirror 205) serving as a deflecting unit. The PD 204 outputs a detection signal of a value (voltage) corresponding to the light power of laser light in response to the reception of the laser light.

The laser light, which has passed through the beam splitter 203, passes through a cylindrical lens 206, and is incident on the polygonal mirror 205. The polygonal mirror 205 has a plurality of reflection surfaces (in this embodiment, four surfaces). The polygonal mirror 205 is rotated in a direction indicated by arrow C when being driven by a motor 207. The polygonal mirror 205 deflects the laser light so that the laser light scans the photosensitive drum 102Y in a direction indicated by arrow D. The laser light deflected by the polygonal mirror 206 passes through an imaging optical system (fθ lens) 208, and is guided onto the photosensitive drum 102Y (onto the photosensitive member) through a mirror 209.

The optical scanning device 104Y includes a beam detector 210 (hereinafter, BD 210) serving as a synchronization signal generating unit. The BD 210 is arranged at a position on a scanning path of the laser light but outside an image formation region on the photosensitive drum 102Y. The BD 210 receives the laser light deflected by the polygonal mirror 205 and generates a horizontal synchronization signal.

Laser Light Source

Figure 3A:
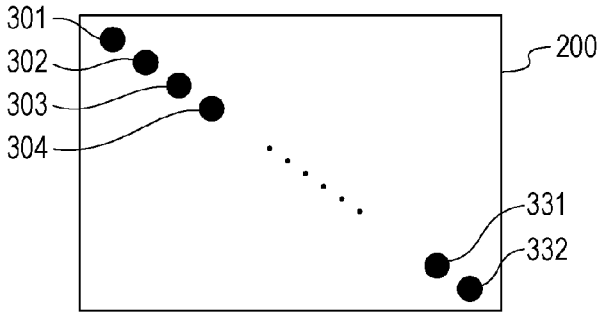
FIG. 3A is an illustration showing arrangement of light-emitting points of a semiconductor laser.
Figure 3B:
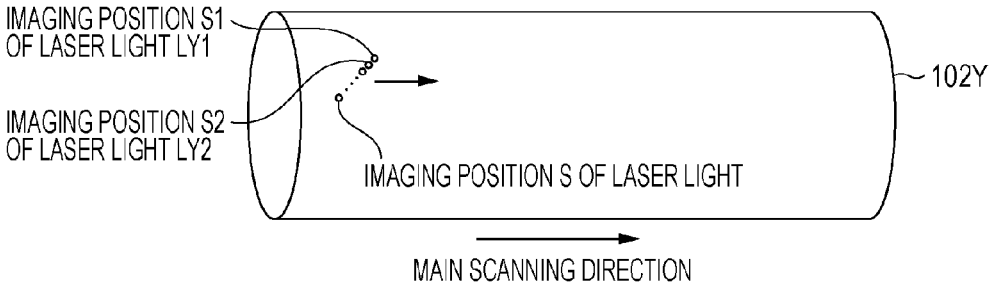
FIG. 3B is an illustration showing exposure positions on a photosensitive drum.

Next, a configuration of the optical scanning devices 104Y, 104M, 104C, and 104Bk is described. FIG. 3A shows a plurality of light-emitting points included in the semiconductor laser 200 shown in FIG. 2. FIG. 3B is an illustration showing an arrangement image of laser spots on the photosensitive drum when laser light is simultaneously emitted from the plurality of light-emitting points.

As shown in FIG. 3A, the semiconductor laser 200 is a Vertical Cavity Surface Emitting Laser (VCSEL) including 32 light-emitting points 301 to 332. In this embodiment, the semiconductor laser is not limited to VCSEL, and may employ an edge emitting laser.

The light-emitting points 301 to 332 are arranged in an array on a substrate 333. Since the light-emitting points are arranged as shown in FIG. 3A, if the light-emitting points are simultaneously lit, laser light L1 to laser light L32 emitted from the respective light-emitting points expose different positions on the photosensitive drum in a main scanning direction to light like imaging positions S1 to S32 in FIG. 3B. Also, if the respective light-emitting points are simultaneously lit, the laser light L1 to the laser light L32 emitted from the respective light-emitting points expose different positions in a sub-scanning direction to light like the imaging positions S1 to S32 in FIG. 3B. The arrangement of the plurality of light-emitting points may be two-dimensional arrangement.

Control Block Diagram

Figure 4:
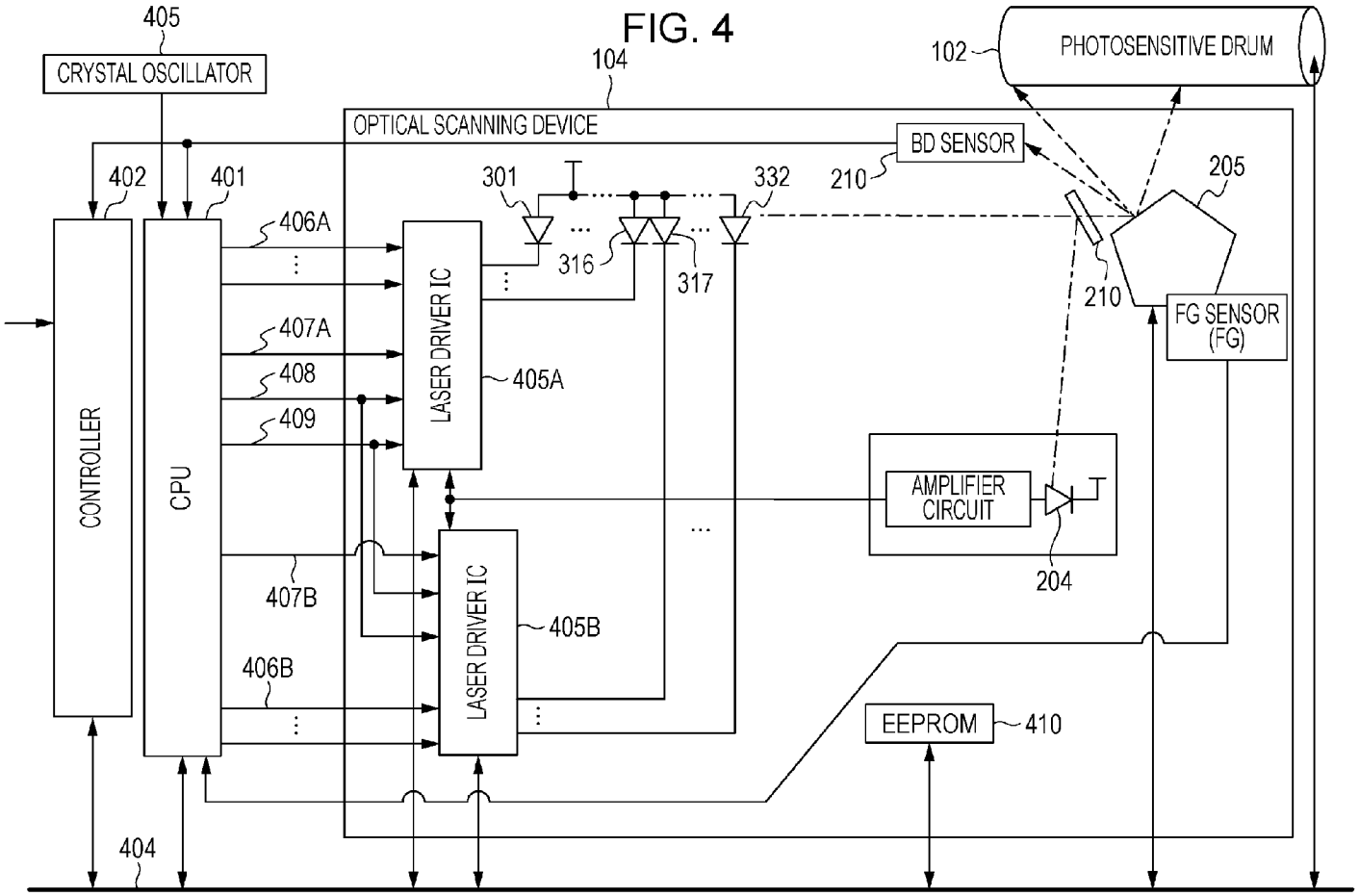
FIG. 4 is a control block diagram of the image forming apparatus according to this embodiment.

FIG. 4 is a block diagram explaining an example of a control system used in the image forming apparatus shown in FIG. 1. The optical scanning devices (also called laser scanners) 104Y, 104M, 104C, and 104Bk have the same configuration, and hence auxiliary characters Y, M, C, and Bk are omitted in the following description. The configurations relating to 32 beams have parallel and repetitive configurations, and hence are partly omitted.

The image forming apparatus includes a CPU 401, an image controller 402, the optical scanning device 104, the photosensitive drum 102, a crystal oscillator 405, a CPU bus 404, and an EEPROM 410. The CPU 401 and the image controller 402 are included in an image forming apparatus body, and are connected with each optical scanning device 104. The optical scanning device 104 includes a first laser driver 405A and a second laser driver 405B. For simple explanation, the first laser driver 405A, the second laser driver 405B, and the light-emitting points 301 to 332 (light-emitting elements) corresponding to one color of Y, M, C, and Bk are described. Actually, the first laser driver 405A, the second laser driver 405B, and the light-emitting points 301 to 332 are provided for each color of Y, M, C, and Bk.

The CPU 401 controls the entire image forming apparatus including the respective optical scanning devices 104. The CPU 401 receives supply of a reference clock with 100 MHz from the crystal oscillator 405. The CPU 401 generates 1 GHz by multiplying the reference clock by 10 by an embedded PLL circuit. This frequency is an image clock in a laser scanning system.

The image controller 402 separates image data received from an external information device connected with the image forming apparatus or the reading device attached to the image forming apparatus, into four-color components of Y, M, C, and Bk. The image controller 402 outputs the image data of the four-color components of Y, M, C, and Bk to the CPU 401 through the CPU bus 404 in synchronization with the reference clock.

The CPU 401 stores the image data received from the image controller 402, in a memory (not shown), and converts the image data stored in the memory into a differential signal (Low Differential Voltage Signal: LVDS) based on the image clock. The CPU 401 outputs the differential signal to the laser drivers 405A and 405B at a timing based on a BD signal and an image clock signal.

The laser drivers 405A and 405B each generate a PWM signal based on the differential signal input from the CPU 401, and emits laser light for forming an electrostatic latent image from the respective light-emitting points 301 to 332 based on the PWM signal. Also, the laser drivers 405A and 405B each execute Automatic light Power Control (APC) including first light power control, second light power control, and third light power control (described later), and hence control the light power of laser light for forming an electrostatic latent image, the value of bias current Ib serving as standby current, and the value of switching current Isw.

The laser drivers 405A and 405B shown in FIG. 4 are each an IC of the same part model number, and each can control 16 light-emitting points. The laser driver 405A controls the light-emitting points 301 to 316, and the laser driver 405B controls the light-emitting points 317 to 332. For a power supply of the two laser drivers, a direct-current 5-V line and a ground line are supplied from a body rear-surface substrate (not shown). Electric power is supplied to the two laser drivers and the light-emitting points 301 to 332 from a common power supply.

The CPU 401 is connected with the laser drivers 405A and 405B by a plurality of signal lines as follows.

A signal line 406A is a signal-line group that transmits a differential signal for driving the light-emitting points 301 to 316 from the CPU 401 to the laser driver 405A. A signal line 406B is a signal-line group that transmits a differential signal for driving the light-emitting points 317 to 332 from the CPU 401 to the laser driver 405B.

A signal line 407A is a signal line that connects the CPU 401 with the laser driver 405A. A signal line 407B is a signal line that connects the CPU 401 with the laser driver 405B.

The CPU 401 transmits an IC select signal icsel_0 to the laser driver 405A through the signal line 407A, and transmits an IC select signal icsel_1 to the laser driver 405B through the signal line 407B. If the IC select signal icsel_0 is at H level, the IC select signal icsel_1 becomes at L level. If the IC select signal icsel_0 is at L level, the IC select signal icsel_1 becomes at H level. The image forming apparatus of this embodiment executes APC on a light-emitting point that is controlled by a laser driver with an IC select signal to be input being at L level.

A signal line 408 and a signal line 409 are signal lines that connect the CPU 401 with the laser drivers 405A and 405B. The signal lines 407A, 407B, 408, and 409 are interfaces for transmitting control mode signals that set control modes of the laser drivers 405A and 405B (described later). The laser drivers 405A and 405B execute various control based on the control mode signals transmitted from the CPU 401.

The EEPROM 410 stores information relating to an APC sequence (described later). The CPU 401 executes light power control on the light-emitting points in the order based on the information relating to the APC sequence stored in the EEPROM 410.

Control Mode

DIS Mode (Disable Mode)

DIS mode is set in an initial state immediately after the power supply of the image forming apparatus is turned ON. Also, DIS mode is set for interlock in a state in which a panel for maintenance is open for maintenance of the image forming apparatus. DIS mode is a state in which an electric charge is discharged from a hold capacitor (described later) and laser light is not emitted from a light-emitting point.

OFF Mode

OFF mode is a mode set in a period (image non-formation period) other than a period (image formation period) in which laser light scans an image formation region on the photosensitive drum during image formation, and in a state in which a laser driver waits for an input of LVDS. In OFF mode, bias current Ib is supplied to each light-emitting point, however, switching current Isw is not supplied to each light-emitting point.

ACC Mode

This is a mode in which a light-emitting point is forcedly lit. ACC mode of the image forming apparatus of this embodiment is a mode in which the light-emitting point 301 is forcedly lit so that laser light from the light-emitting point 301 scans the BD 210 in each scanning period.

VDO Mode

VDO mode (VIDEO mode) is a mode set in the image formation period. This is a mode in which bias current Ib is supplied to each light-emitting point, and switching current Isw is controlled to be turned ON/OFF based on a PWM signal generated from LVDS input to a laser driver.

APC Mode

APC mode is a mode in which APC is executed. The value of bias current Ib is controlled based on the results of the first light power control and the second light power control in APC (described later). The value of switching current Isw is controlled based on the result of the third light power control (described later). The APC mode is a mode set in the image non-formation period to execute the first light power control, the second light power control, and the third light power control, in a period other than OFF mode.

APC

Hereinafter, APC that is executed by the image forming apparatus of this embodiment is described in detail.

Figure 5:
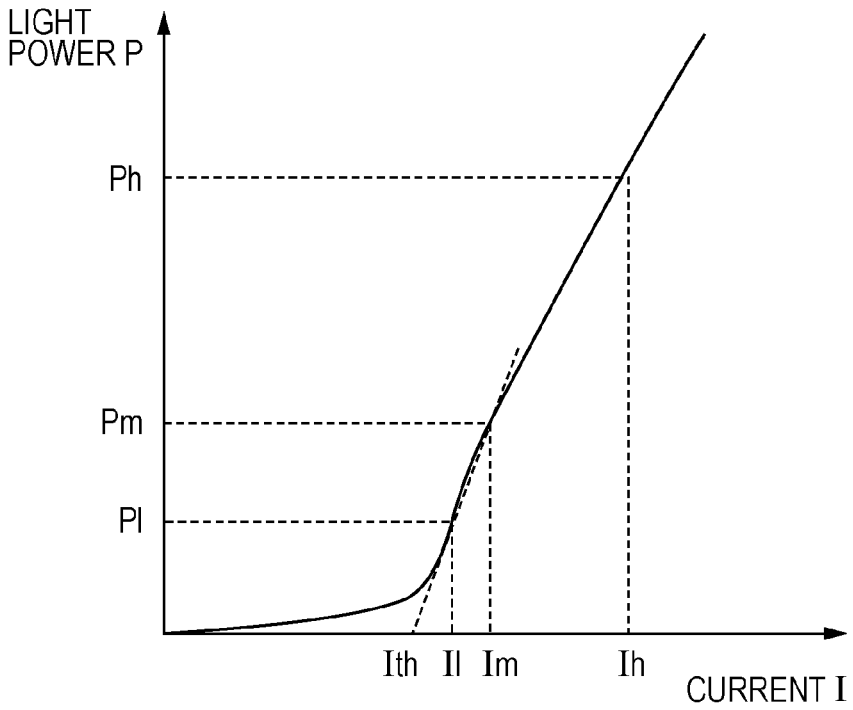
FIG. 5 is an emission characteristic of a certain light-emitting point of the semiconductor laser.

First, bias current Ib and switching current Isw are described. FIG. 5 is an illustration showing an emission characteristic of a certain light-emitting point of the semiconductor laser. The horizontal axis plots the current value supplied to the light-emitting point, and the vertical axis plots the light power of the laser light. The curve in FIG. 5 indicates the light power of laser light with respect to the current value supplied to each light-emitting point. The emission characteristic is a characteristic unique to each light-emitting point. Also, the emission characteristic is changed with temperature of the light-emitting point, and is changed with time. Hence, the electrophotographic image forming apparatus is required to execute APC with high frequency to restrict generation of image density unevenness caused by variation in emission characteristic.

As shown in FIG. 5, generally, in a semiconductor laser, the increase in light power of laser light with respect to the increase amount of the current value is small in a region in which the value of current supplied to a light-emitting point is lower than a threshold current Ith, but in contrast, the increase amount of the light power of laser light with respect to the increase amount of the current is large in a region in which the value of current is higher than the threshold current Ith. If current with the threshold current Ith or lower is supplied, the semiconductor laser is not induced to oscillate, but spontaneously emits light. Since the light power produced by the spontaneous emission is very small, even if the spontaneous emission is provided, the potential of the photosensitive drum is not changed.

By using such a characteristic of a semiconductor laser, in the electrophotographic image forming apparatus, the bias current Ib having a value near the threshold current Ith is supplied to a light-emitting point to restrict a decrease in emission response. In a state in which the bias current Ib is supplied, by supplying the switching current Isw based on the PWM signal generated from LVDS, laser light with intensity that changes the potential of the surface of the photosensitive drum is emitted from the light-emitting point. Since the light-emitting point is lit from the state in which the bias current Ib is supplied, the reach time of the laser light to the target light power can be decreased as compared with a case in which the light-emitting point is lit from a state in which the bias current Ib is not supplied.

Next, control of the value of bias current Ib in the image forming apparatus of this embodiment is described. The laser driver 405A and the laser driver 405B execute the first light power control and the second light power control at different timings on the light-emitting points 301 to 332. Herein, the first light power control and the second light power control are described by using the laser driver 405A and the light-emitting point 301.

As described above, the laser driver 405A executes the first light power control that controls the value of current supplied to the light-emitting point 301 so that the light power received by the PD 204 becomes Pm. The laser driver 405A holds a current value Im corresponding to the light power Pm as the control result of the first light power control.

Also, the laser driver 405A executes the second light power control that controls the value of current supplied to the light-emitting point 301 so that the light power received by the PD 204 becomes Pl (Pl=Pm/2). The laser driver 405A holds a current value Il corresponding to the light power Pl as the control result of the second light power control.

When the laser driver 405A executes the first light power control and the second light power control on the light-emitting point 301, the laser driver 405A supplies only the bias current Ib with a value corresponding to each of the light-emitting points 302 to 316, to the light-emitting points 302 to 316. Also, the laser driver 405B similarly supplies only the bias current Ib corresponding to each of the light-emitting points 317 to 332, to the light-emitting points 317 to 332 (OFF mode).

The laser driver 405A obtains the intersection of the segment connecting (Im, Pm) and (Il, Pl) (correspondence) and the axis indicative of the light power being "0" in FIG. 5 by calculation, and sets the value of the intersection at the current threshold Ith. The laser driver 405A updates (resets) the value of bias current Ib by multiplying the current threshold Ith by a predetermined coefficient $\alpha$. The coefficient $\alpha$ is previously set in accordance with the sensitivity of the sensitive drum attached to the image forming apparatus, and may be a value being 1 or larger, or a value smaller than 1.

Next, control of the value of switching current Isw in the image forming apparatus of this embodiment is described. The laser driver 405A executes the third light power control that controls the value of current supplied to the light-emitting point 301 in addition to the first light power control and the second light power control so that the light power received by the PD 204 becomes Ph (Ph=Pm×2). The laser driver 405A holds a current value Ih corresponding to the light power Ph as the control result of the third light power control. The value of switching current Isw is a value obtained by subtracting the value of bias current Ib from a value obtained by multiplying the current value Ih by a coefficient $\beta$, which is set based on certain conditions of the image forming apparatus ($Ip=\beta Ih-Ib$).

Laser Driver

Next, a configuration of a laser driver for executing the first light power control, the second light power control, and the third light power control in aforementioned APC is described.

Figure 6:
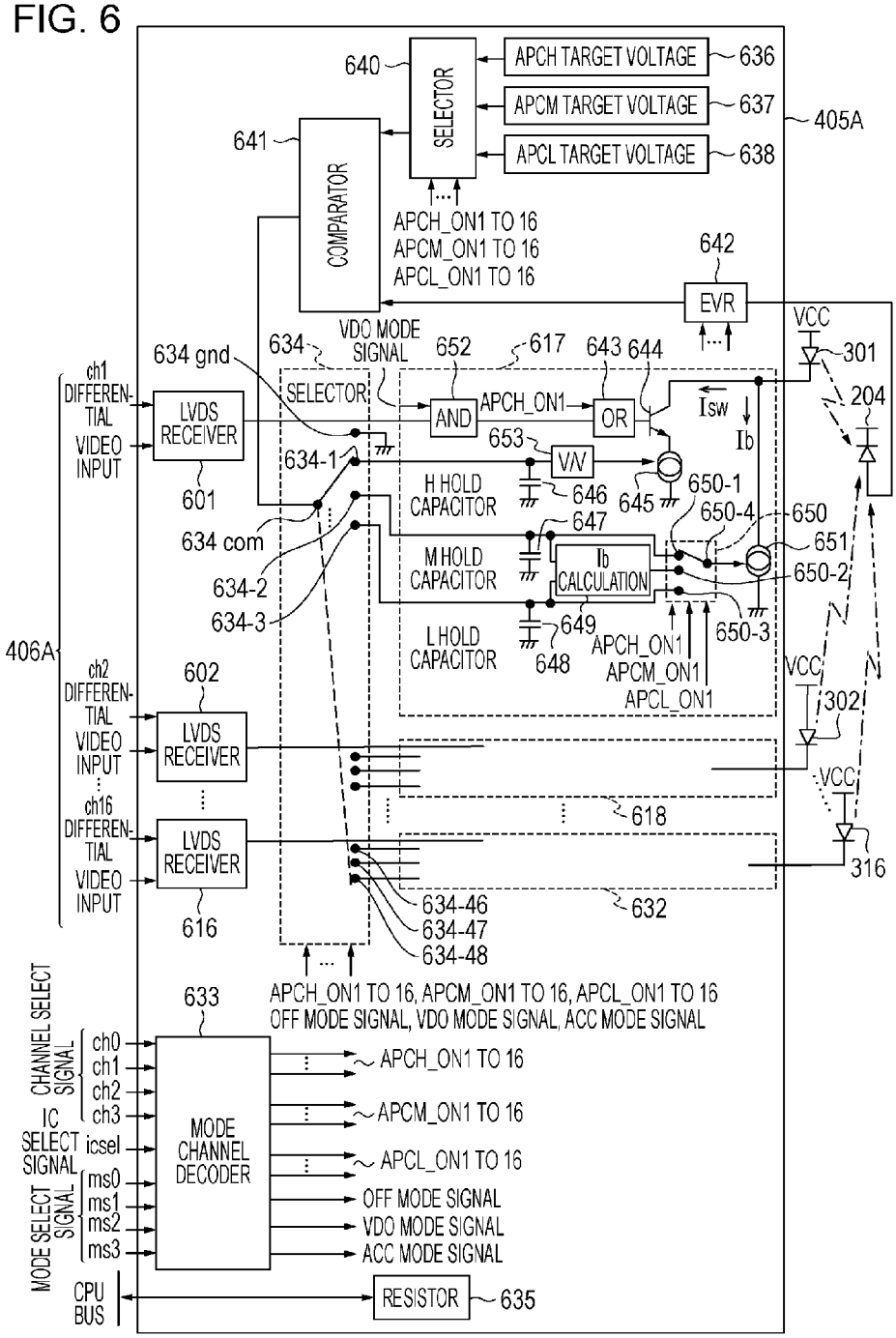
FIG. 6 is a schematic configuration diagram of a laser driver.

FIG. 6 is an illustration showing an inner configuration of the laser driver 405A. The laser driver 405B has the same inner configuration as the inner configuration of the laser driver 405A. Hence, the description of the laser driver 405B is omitted.

The laser driver 405A includes a mode channel decoder 633. Also, the laser driver 405A includes driving units 617 to 632, LVDS receivers 601 to 616, AND circuits 652, OR circuits 643, transistors 644, and switching power supplies 645, respectively corresponding to the light-emitting points 301 to 316. Also, the laser driver 405A includes a first voltage output unit 636 that outputs a target voltage Vm (comparison signal) corresponding to the first light power (Pm) to the light-emitting points 301 to 316, a second voltage output unit 637 that outputs a target voltage Vl (comparison signal) corresponding to the second light power (Pl) to the light-emitting points 301 to 316, and a third voltage output unit 638 that outputs a target voltage Vh (comparison signal) corresponding to the third light power Ph to the light-emitting points 301 to 316. Further, the laser driver 405A includes a selector 640, a comparator 641, an EVR 642, the mode channel decoder 633, a selector 634, and a resistor 635.

First, the mode channel decoder 633 is described. The mode channel decoder 633 has a function of changing the control mode of the laser driver 405A among DIS mode, VDO mode, OFF mode, ACC mode, and APC mode, based on a mode select signal, a channel select signal, and an IC select signal from the CPU 401.

The CPU 401 outputs the IC select signal (icsel_0) to the mode channel decoder 633. The mode channel decoder 633 controls the laser driver 405A to be in the APC mode based on the IC select signal from the CPU 401. The mode channel decoder provided in the laser driver 405B controls the laser driver 405B to be in the APC mode based on the IC select signal from the CPU 401 if the laser driver 405A is not in the APC mode at a timing at which APC should be executed. That is, one of the laser driver 405A and the laser driver 405B is selectively transitioned to the APC mode by the IC select signal at the timing at which APC is executed.

The CPU 401 outputs a mode select signal group (ms0, ms1, ms2, ms3) and a channel select signal group (ch0, ch1, ch2, ch3) to the mode channel decoder 633. The mode channel decoder 633 generates APC mode signals (APCH_ON1-16, APCM_ON1-16, APCL_ON1-16) based on the mode select signal group and the channel select signal group from the CPU 401.

The mode channel decoder 633 outputs an APC mode signal to the laser driver 405A in the APC mode. The APC mode signal APCH_ON is a signal that causes the laser driver 405A to execute the third light power control. The APC mode signal APCM_ON is a signal that causes the laser driver 405A to execute the first light power control. The APC mode signal APCL_ON is a signal that causes the laser driver 405A to execute the second light power control.

The mode channel decoder 633 outputs the APC mode signals APCH_ON, APCM_ON, and APCL_ON to each of the light-emitting points 301 to 316 at different timings. That is, the mode channel decoder 633 generates 48 APC mode signals in total including the APC mode signals APCH_ON1-16, the APC mode signals APCM_ON1-16, and the APC mode signals APCL_ON1-16. One signal among the 48 APC mode signals is at H level. The laser drivers 405A and 405B each execute the light power control on the light-emitting point corresponding to the APC mode signal output from the mode channel decoder 633, which is included in each of the laser drivers 405A and 405B.

FIG. 7A is a table showing the mode select signals, the channel select signals, and the IC select signal output from the CPU and corresponding to the various control modes. In FIG. 7A, "DIS" represents DIS mode, and "ACC" represents ACC mode. Also, "VDO" represents VDO mode, and "OFF" represents OFF mode. "APCH," "APCM," and "APCL" respectively represent the third light power control, the first light power control, and the second light power control.

Wording "ic" represents IC select signals icsel_0 and icsel_1. If the input mode select signal indicates execution of APC and the IC select signal is at L level, the laser drivers 405A and 405B are brought into a state in which the laser drivers 405A and 405B can execute the first light power control, the second light power control, and the third light power control.

Each control mode is controlled based on a combination of the mode select signals ms0, ms1, ms2, and ms3 shown in FIG. 7A. [1] in the table indicates all combinations other than a combination of mode select signals in any of DIS mode, ACC mode, APCH mode, APCM mode, and APCL mode. [2] in the table represents that the control state is determined regardless of the IC select signal or the channel select signal (ch0, ch1, ch2, ch3). [*] in the table indicates a combination of channel select signals shown in FIG. 7B. Characters e1 to e16 in FIG. 7B respectively correspond to the light-emitting points 301 to 316.

Herein, an example of a method of referencing the table is described. If the combination of the mode select signals ms3, ms2, ms1, and ms0 output from the CPU 401 is "L," "L," "H," and "L," and the combination of the channel select signals output from the CPU 401 is "L," "H," "L," and "L," the first light power control is executed on the light-emitting point 305. The mode channel decoder 633 controls only APCM_ON5 at H level among the 48 APC mode signals, based on the mode-select signals and the channel select signals, and controls the other APC mode signals at L level.

Next, the driving units 617 to 632 are described. The driving units 617 to 632 are provided respectively for the light-emitting points 301 to 316, and each supply driving current to the corresponding light-emitting point. The driving units 617 to 632 have the same configuration, and hence an inner configuration of the driving unit 617 is exemplarily described.

The driving unit 617 includes an M hold capacitor 647, an L hold capacitor 648, an Ib calculation unit 649, the selector 634, and a bias current source 651. Also, the driving unit 617 includes the AND circuit 652, the OR circuit 643, a transistor 644, a switching current source 645, an H hold capacitor 646, and a voltage regulating circuit 653.

As shown in FIG. 6, the bias current source 651 and the switching current source 645 are connected with the light-emitting point 301. The bias current source 651 and the switching current source 645 are lead-in current sources that respectively lead the bias current Ib and the switching current Isw from VCC. In any of VDO mode, OFF mode, ACC mode, and APC mode, the bias current Ib is supplied to the light-emitting point 301 by the bias current source 651.

The Ib calculation unit 649 is connected with the M hold capacitor 647 and the L hold capacitor 648. The Ib calculation unit 649 calculates the value of bias current Ib based on the control result of the first light power control (voltage of M hold capacitor 647) and the control result of the second light power control (voltage of L hold capacitor 648).

Next, the LVDS receivers 601 to 616; and the AND circuit 652, the OR circuit 643, the transistor 644, and the switching current source 645 of the driving unit 617 are described. Since the LVDS receivers 601 to 616 have the same configuration, the LVDS receiver 601 is exemplarily described. The LVDS receiver 601 receives a differential signal, which is image data, from the CPU 401. The LVDS receiver 601 outputs a PWM signal to the AND circuit 652 based on the differential signal. The PWM signal is input from the LVDS receiver 601 to one terminal of the AND circuit 652, and a VDO mode signal is input from the mode channel decoder 633 to the other terminal of the AND circuit 652. If the VDO mode signal input to the AND circuit 652 is at H level and if the PWM signal is at H level, the AND circuit 652 outputs a signal at H level. If at least one of the VDO mode signal and the PWM signal input to the AND circuit 652 is at H level, the AND circuit 652 outputs a signal at L level.

The output signal from the AND circuit 652 is input to one terminal of the OR circuit 643, and APCH_ON1, which is an APC mode signal from the mode channel decoder 633, is input to the other terminal of the OR circuit. If at least one of the output signal from the AND circuit 652 and APCH_ON1 is at H level, the OR circuit 643 outputs a signal at H level. If both the output signal from the AND circuit 652 and APCH_ON1 are at L level, the OR circuit 643 outputs a signal at L level.

The output of the OR circuit 643 is connected with a base terminal of the transistor 644. A collector terminal of the transistor 644 is connected with the light-emitting point 301. Also, an emitter terminal of the transistor 644 is connected with the switching current source 645. If the signal at H level is output from the OR circuit 643, the switching current source 645 leads the switching current Isw from VCC. Accordingly, the switching current Isw is supplied to the light-emitting point 301 for emitting laser light. If the signal at L level is output from the OR circuit 643, the area between the collector terminal and the emitter terminal of the transistor 644 becomes a current non-conducting state.

The selector 640 selects one of the output signal (Vh) of the APCH target voltage output unit 636, the output signal (Vm) of the APCH target voltage output unit 637, and the output signal (Vl) of the APCH target voltage output unit 638, based on APCH_ON1-16, APCM_ON1-16, and APCL_ON1-16 output from the mode channel decoder 633. The output signal Vh from the APCH target voltage output unit 636 is a voltage corresponding to the third light power Ph (target light power). The output signal Vm from the APCM target voltage output unit 637 is a voltage corresponding to the first light power Pm (target light power). The output signal Vl from the APCL target voltage output unit 638 is a voltage corresponding to the second light power Pl (target light power).

The selector 634 includes a terminal 634com that is connected with the comparator 641, a terminal 634gnd that is grounded, and terminals 634-1 to 634-48. As shown in FIG. 6, the terminal 634-1 is connected with the H hold capacitor 646 of the driving unit 617. Also, the terminal 634-2 is connected with the M hold capacitor 647 of the driving unit 617. Further, the terminal 634-3 is connected with the L hold capacitor 648 of the driving unit 617. The other terminals 634-4 to 634-48 are similarly connected with the corresponding driving units.

The selector 634 receives the APC mode signals APCH_ON1-16, APCM_ON1-16, APCL_ON1-16, the OFF mode signal, the VDO mode signal, and the ACC mode signal from the mode channel decoder 633. If the VDO mode signal, the OFF mode signal, and the ACC mode signal are input, the selector 634 connects the terminal 634com with the terminal 634gnd so that charging or discharging of the H hold capacitor 646, the M hold capacitor 647, or the L hold capacitor 648 is not performed. In contrast, if the APC mode signals APCH_ON1-16, APCM_ON1-16, and APCL_ON1-16 are input, a terminal corresponding to the signal at H level among the terminals 634-1 to 634-48 is connected with the terminal 634com.

A selector 650 provided in the driving unit 617 receives the APC mode signals APCH_ON1, APCM_ON1, APCL_ON1, the VDO mode signal, the OFF mode signal, and the ACC mode signal from the mode channel decoder 633. The driving units 618 to 632 receive corresponding APC mode signals. The selector 650 includes a terminal 650-1 connected with the M hold capacitor 647, a terminal 650-2 connected with the Ib calculation unit 649, a terminal 650-3 connected with the L hold capacitor 648, and a terminal 650-4 connected with the bias current source 651.

If the APC mode signal APCH_ON1, the VDO mode signal, the OFF mode signal, and the ACC mode signal are input, the selector 650 connects the terminal 650-2 with the terminal 650-4. If APCM_ON1 is input, the selector 650 connects the terminal 650-1 with the terminal 650-4. If the APCL_ON1 is input, the selector 650 connects the terminal 650-3 with the terminal 650-4.

The EVR 642 receives a detection signal from the PD 204. The EVR 642 has a function of correcting the detection signal to a value corresponding to each light source based on the light power adjustment table. An EVR 642 receives an input. The EVR 642 receives the APCH_ON1-16, APCM_ON1-16, and APCL_ON1-16.

In EVR, magnification adjustment coefficients corresponding to optical collection efficiencies of the PD sensor and respective laser elements previously measured in a factory and set in the resistor 635 in an APC preparation phase are prepared as table data, and a table is selected in accordance with APCH_ON1-16, APCM_ON1-16, and APCL_ON1-16.

First Light Power Control

The CPU 401 executes the first light power control that controls the voltage of the M hold capacitor 647. The mode channel decoder 633 outputs the APC mode signal APCM_ON1 for execution of the first light power control on the light-emitting point 301 to the selector 634, the selector 640, and the selector 650 based on the mode select signal and the channel select signal from the CPU 401.

The selector 634 connects the terminal 634com with the terminal 634-2 in response to the input of the APC mode signal APCM_ON1. The selector 640 selects a comparison signal Stm output from the target voltage output unit 637 in response to the input of the APC mode signal APCM_ON1, and inputs the comparison signal Stm to the comparator 641. The selector 650 connects the terminal 650-1 with the terminal 650-4 in response to the input of the APC mode signal APCM_ON1.

When the selector 650 connects the terminal 650-1 with the terminal 650-4, the bias current source 651 leads current with a value based on the voltage of the M hold capacitor 647 from VCC. With this current, the light-emitting point 301 emits laser light. The laser light emitted from the light-emitting point 301 is incident on the PD 204. The PD 204 outputs a detection signal corresponding to the light power of the laser light.

The comparator 641 compares the comparison signal Vm from the selector 640 with an amplification signal Samp from the amplifier circuit 642, and outputs the signal based on the comparison result to the selector 634. To be specific, if voltage of Samp (Vamp)>Vm, since the light power of laser light incident on the PD 204 is larger than the first light power Pm, the comparator 641 causes the M hold capacitor 647 to discharge electricity. If discharge of the M hold capacitor 647 is continued, the light power of laser light incident on the PD 204 is decreased, and becomes close to the first light power Pm. The comparator 641 holds the voltage of the M hold capacitor 647 in response to establishment of Vamp=Vm (or Vamp≈Vm).

In contrast, if Vamp<Vtm, since the light power of laser light incident on the PD 204 is smaller than the first light power Pm, the comparator 641 charges the M hold capacitor 647. If charge of the M hold capacitor 647 is continued, the light power of laser light incident on the PD 204 is increased, and becomes close to the first light power Pm. The comparator 641 holds the voltage of the M hold capacitor 647 in response to establishment of Vamp=Vm (or Vamp≈Vm).

If Vamp=Vm, since the light power of laser light incident on the PD 204 is the first light power Pm, the comparator 641 holds the voltage of the M hold capacitor 647 in this state.

As described above, in the first light power control of APC, by controlling the voltage of the M hold capacitor 647, the light power of laser light emitted from the light-emitting point 301 and being incident on the PD 204 is controlled to be the first light power.

Second Light Power Control

Next, the CPU 401 executes the second light power control that controls the voltage of the L hold capacitor 648. The mode channel decoder 633 outputs the APC mode signal APCL_ON1 for execution of the second light power control on the light-emitting point 301 to the selector 634, the selector 640, and the selector 650 based on the mode select signal from the CPU 401.

The selector 634 connects the terminal 634com with the terminal 634-3 in response to the input of the APC mode signal APCL_ON1. The selector 640 selects the comparison signal Vl output from the target voltage output unit 638 in response to the input of the APC mode signal APCL_ON1, and inputs the comparison signal Vl to the comparator 641. The selector 650 connects the terminal 650-3 with the terminal 650-4 in response to the input of the APC mode signal APCL_ON1.

When the selector 650 connects the terminal 650-3 with the terminal 650-4, the bias current source 651 leads current with a value based on the voltage of the L hold capacitor 648 from VCC. With this current, the light-emitting point 301 emits laser light. The laser light emitted from the light-emitting point 301 is incident on the PD 204. The PD 204 outputs a detection signal corresponding to the light power of the laser light.

The comparator 641 compares the comparison signal Vl from the selector 640 with the amplification signal Samp (Vamp) from the amplifier circuit 642, and outputs the signal based on the comparison result to the selector 634. To be specific, if Vamp>Vl, since the light power of laser light incident on the PD 204 is larger than the second light power Pl, the comparator 641 causes the L hold capacitor 648 to discharge electricity. If discharge of the L hold capacitor 648 is continued, the light power of laser light incident on the PD 204 is decreased, and becomes close to the second light power Pl. The comparator 641 holds the voltage of the L hold capacitor 648 in response to establishment of Vamp=Vl (or Vamp≈Vl).

In contrast, if Vamp<Vl, since the light power of laser light incident on the PD 204 is smaller than the second light power Pl, the comparator 641 charges the L hold capacitor 648. If charge of the L hold capacitor 648 is continued, the light power of laser light incident on the PD 204 is increased, and becomes close to the second light power Pl. The comparator 641 holds the voltage of the L hold capacitor 648 in response to establishment of Vamp=Vl (or Vamp≈Vl).

If Vamp=Vl, since the light power of laser light incident on the PD 204 is the first light power Pm, the comparator 641 holds the voltage of the L hold capacitor 648 in this state.

As described above, in the second light power control of APC, by controlling the voltage of the L hold capacitor 648, the light power of laser light emitted from the light-emitting point 301 and being incident on the PD 204 is controlled to be the second light power Pl.

Calculation of Bias Current

In response to completion of the first light power control and the second light power control as described above, the Ib calculation unit 649, which is a bias current control unit, calculates the value of bias current Ib based on the control result of the first light power control and the control result of the second light power control. The calculation method is as described above.

When the first light power control or the second light power control is not performed on the light-emitting point 301, the selector 650 connects the terminal 650-2 with the terminal 650-4. By connecting the terminal 650-2 with the terminal 650-4, the Ib calculation unit 649 calculates the value of bias current Ib, and outputs a control signal, which is the calculation result, to the bias current source 651. The bias current source 651 leads the bias current with the value based on the control signal from the Ib calculation unit 649 from VCC. The value of bias current is similarly controlled for any of the other light-emitting points 302 to 332.

Third Light Power Control

The value of switching current Isw is determined depending on the voltage of the H hold capacitor 646. The CPU 401 executes the third light power control that controls the voltage of the H hold capacitor 646 to control the value of switching current Isw. The third light power control for the light-emitting point 301 is executed in a state in which the bias current Ib is supplied to the light-emitting point 301.

The CPU 401 executes the third light power control that controls the voltage of the M hold capacitor 647. The mode channel decoder 633 outputs the APC mode signal APCH_ON1 for execution of the third light power control on the light-emitting point 301 to the selector 634, the selector 640, the selector 650, and the OR circuit 643 based on the mode select signal from the CPU 401.

The selector 634 connects the terminal 634com with the terminal 634-1 in response to the input of the APC mode signal APCH_ON1. The selector 640 selects the comparison signal Vh output from the target voltage output unit 636 in response to the input of the APC mode signal APCH_ON1, and inputs the comparison signal Vh to the comparator 641. The selector 650 connects the terminal 650-2 with the terminal 650-4 in response to the input of the APC mode signal APCH_ON1.

Since the terminals 650-2 and 650-4 of the selector 650 are connected, the bias current Ib is supplied to the light-emitting point 301. In response to the input of the APC mode signal APCH_ON1 to the OR circuit 643, the transistor 644 can transmit electricity, and the switching current source 645 supplies the switching current Isw to the light-emitting point 301. Since current is supplied in the state in which the bias current Ib is supplied, the light-emitting point 301 emits laser light. The laser light emitted from the light-emitting point 301 is incident on the PD 204. The PD 204 outputs a detection signal corresponding to the light power of the laser light.

The comparator 641 compares the comparison signal Vh from the selector 640 with the amplification signal Samp (Vamp) from the amplifier circuit 642, and outputs a signal based on the comparison result to the selector 634. To be specific, if Vamp>Vh), since the light power of laser light incident on the PD 204 is larger than the third light power Ph, the comparator 641 causes the H hold capacitor 646 to discharge electricity. If discharge of the H hold capacitor 646 is continued, the light power of laser light incident on the PD 204 is decreased, and becomes close to the third light power Ph. The comparator 641 holds the voltage of the H hold capacitor 646 in response to establishment of Vamp=Vh (or Vamp≈Vh).

In contrast, if Vamp<Vh, since the light power of laser light incident on the PD 204 is smaller than the third light power Ph, the comparator 641 charges the H hold capacitor 646. If charge of the H hold capacitor 646 is continued, the light power of laser light incident on the PD 204 is increased, and becomes close to the third light power Ph. The comparator 641 holds the voltage of the H hold capacitor 646 in response to establishment of Vamp=Vh (or Vamp≈Vh).

If Vamp=Vh, since the light power of laser light incident on the PD 204 is the third light power Ph, the comparator 641 holds the voltage of the H hold capacitor 646 in this state.

As described above, in the third light power control of APC, by controlling the voltage of the H hold capacitor 646, the light power of laser light emitted from the light-emitting point 301 and being incident on the PD 204 is controlled to be the third light power Ph by controlling the voltage of the H hold capacitor 646.

As shown in FIG. 6, the voltage regulating circuit 653 is connected between the H hold capacitor 646 and the switching current source 645. The voltage regulating circuit 653 receives a voltage control signal (not shown) from the CPU 401. The voltage control signal is a signal for regulating the voltage of the H hold capacitor 646. The CPU 401 generates the voltage control signal based on the state of the image forming apparatus (for example, sensitivity of photosensitive drum with respect to laser light, charging state of toner, and temperature in apparatus) and based on the environmental state in which the image forming apparatus is installed (temperature, humidity). The switching current source 645 supplies the switching current Isw with the value based on the voltage regulated by the voltage regulating circuit 653, to the light-emitting point 301.

The voltage regulating circuit 653 also receives the APC mode signal APCH_ON and the VDO mode signal. If the APCH_ON signal is input, the voltage regulating circuit 653 does not regulate the voltage of the H hold capacitor 646 according to the voltage control signal.

In this embodiment, second light power<first light power<third light power is established. However, the magnitudes of the light powers are not limited thereto.

Supply of Switching Current

The LVDS receiver 601 outputs the PWM signal to the AND circuit 652. The PWM signal is input from the LVDS receiver 601 to one terminal of the AND circuit 652, and a mode signal (VDO mode signal) is input from the mode channel decoder 633 to the other terminal of the AND circuit 652. If the VDO mode signal input to the AND circuit 652 is at H level and if the PWM signal input to the AND circuit 652 is at H level, the AND circuit 652 outputs a signal at H level. If at least one of the VDO mode signal and the PWM signal input to the AND circuit 652 is at L level, the AND circuit 652 outputs a signal at L level.

The output signal from the AND circuit 652 is input to one terminal of the OR circuit 643, and the APCH_ON signal from the mode channel decoder 633 is input to the other terminal of the OR circuit. If at least one of the output signal from the AND circuit 652 and the APCH_ON signal is at H level, the OR circuit 643 outputs a signal at H level. If both the output signal from the AND circuit 652 and the APCH_ON signal are at L level, the OR circuit 643 outputs a signal at L level.

The output of the OR circuit 643 is connected with a base terminal of the transistor 644. A collector terminal of the transistor 644 is connected with the light-emitting point 301. Also, an emitter terminal of the transistor 644 is connected with the switching current source 645. When the signal at H level is output from the OR circuit 643, the switching current source 645 leads the switching current Isw from VCC. Accordingly, the switching current Isw is supplied to the light-emitting point 301 for emitting laser light. If the signal at L level is output from the OR circuit 643, the area between the collector terminal and the emitter terminal of the transistor 644 becomes a current non-conducting state.

APC Sequence

Next, an APC sequence that is a feature of the image forming apparatus of this embodiment is described. Execution timings of the first light power control, second light power control, and third light power control according to APC on the each light-emitting point are controlled by the APC mode signal group (APC mode signal APCH_ON, APCM_ON, APCL_ON) output from the mode channel decoder 633.

FIG. 7A is a table showing the mode select signals, the channel select signals, and the IC select signal output from the CPU and corresponding to various control modes. In FIG. 7A, "DIS" represents DIS mode, and "ACC" represents ACC mode. Also, "VDO" represents VDO mode, and "OFF" represents OFF mode. "APCH," "APCM," and "APCL" respectively represent the third light power control, the first light power control, and the second light power control.

Wording "ic" represents an IC select signal. If the input mode select signal indicates execution of APC and the IC select signal is at L level, the laser drivers 405A and 405B are brought into a state in which the laser drivers 405A and 405B can execute the first light power control, the second light power control, and the third light power control.

Each control mode is controlled based on a combination of the mode select signals ms0, ms1, ms2, and ms3 shown in FIG. 7A. [1] in the table indicates all combinations other than a combination of mode select signals in any of DIS mode, ACC mode, APCH mode, APCM mode, and APCL mode. [2] in the table represents "don't care" and represents that the control state is determined regardless of a pd control signal and the channel select signal (ch0, ch1, ch2, ch3). [*] in the table indicates a combination of channel select signals shown in FIG. 7B. Characters e1 to e16 in FIG. 7B respectively correspond to the light-emitting points 301 to 316.

Herein, an example of a method of referencing the table is described. If the combination of the mode select signals ms3, ms2, ms1, and ms0 output from the CPU 401 is "L," "L," "H," and "L," and the combination of the channel select signals output from the CPU 401 is "L," "H," "L," and "L," the first light power control is executed on the light-emitting point 305. The mode channel decoder 633 controls only APCM_ON5 at H level among the 48 APC mode signals, based on the mode-select signals and the channel select signals, and controls the other APC mode signals at L level.

FIGS. 8A to 8D are illustrations explaining execution orders of the first light power control, second light power control, and third light power control for the light-emitting points 301 to 332 in the APC mode in the image forming apparatus according to this embodiment. FIG. 8A to FIG. 8D are examples of execution orders of the first light power control, second light power control, and third light power control. Data relating to an execution order is stored in the EEPROM 410 so that the first light power control, second light power control, and third light power control are executed in any one of the orders when the image forming apparatus is assembled. The mode channel decoder 633 outputs the APC mode signal by using the table shown in FIGS. 7A and 7B so that the first light power control, second light power control, and third light power control are executed in the order.

In FIG. 8A to FIG. 8D, the row number indicates the scanning period, and the column number indicates the order of the light power control for each light-emitting point in each scanning period. Also, in FIG. 8A to FIG. 8D, sign H in one cell in the table indicates the third light power control, M indicates the first light power control, and L indicates the second light power control. A number attached to each of H, M, and L indicates a light-emitting point on which the light power control is executed. For example, H1 indicates that the third light power control is executed on the light-emitting point 301, and M4 indicates that the first light power control is executed on the light-emitting point 304.

FIG. 8A indicates a sequence that completes APC on the light-emitting points 301 to 332 in 12 scanning periods. If the APC sequence shown in FIG. 8A is set in the EEPROM 410, the CPU 401 executes the third light power control on the light-emitting points 301 to 308 in the N scanning period, executes the first light power control on the light-emitting points 301 to 308 in the next N+1 scanning period, and executes the second light power control on the light-emitting points 301 to 308 in the N+2 scanning period.

In this way, the image forming apparatus of this embodiment executes different light power controls on the same light-emitting point in a plurality of scanning periods. That is, the laser driver 405A executes the first light power control on a certain light-emitting point group in a period from generation of a first BD signal (first synchronization signal) to generation of a second BD signal (second synchronization signal). Then, the laser driver 405A executes the second light power control on the light-emitting point group in a period from generation of the second BD signal to generation of a next third BD signal (third synchronization signal). Then, the laser driver 405A executes the third light power control on the light-emitting point group in a period from generation of the third BD signal to generation of a fourth BD signal (fourth synchronization signal). The execution order of the first light power control, second light power control, and third light power control is not limited thereto.

Similarly, the CPU 401 executes the third light power control on the light-emitting points 309 to 316 in the N+3 scanning period, executes the first light power control on the light-emitting points 309 to 316 in the next N+4 scanning period, and executes the second light power control on the light-emitting points 309 to 316 in the N+5 scanning period. The CPU 401 executes the third light power control on the light-emitting points 317 to 324 in the N+6 scanning period, executes the first light power control on the light-emitting points 317 to 324 in the next N+7 scanning period, and executes the second light power control on the light-emitting points 317 to 324 in the N+8 scanning period. The CPU 401 executes the third light power control on the light-emitting points 325 to 332 in the N+9 scanning period, executes the first light power control on the light-emitting points 325 to 332 in the next N+10 scanning period, and executes the second light power control on the light-emitting points 325 to 332 in the N+11 scanning period. After the second light power control in the N+11 scanning period is ended, the CPU 401 returns to the APC sequence in the N scanning period again. As described above, the CPU 401 executes APC on the respective light-emitting points over the plurality of scanning periods.

In the APC sequence in FIG. 8A, when the first light power control on the light-emitting points in the N+1 scanning period is completed, the Ib calculation unit 649 calculates the value of bias current Ib based on the control result of the first light power control executed in the N+1 scanning period and the control result of the second light power control executed in the N+2 scanning period. Also, when the second light power control on the light-emitting points in the N+2 scanning period is completed, the Ib calculation unit 649 calculates the value of bias current Ib based on the control result of the first light power control executed in the N+1 scanning period and the control result of the second light power control executed on the N+2 scanning period. That is, the Ib calculation unit 649 calculates the value of bias current Ib based on the latest voltage of the M hold capacitor 647 and the latest voltage of the L hold capacitor 648.

FIG. 8B shows an example in which the respective light power controls according to APC are executed on four light-emitting points per one scanning period, and the respective light power controls according to APC are completed once in 24 scanning periods. FIG. 8C shows an example in which the respective light power controls according to APC are executed on three light-emitting points per one scanning period, and the respective light power controls according to APC are completed once in 36 scanning periods. FIG. 8D shows an example in which the respective light power controls according to APC are executed on two light-emitting points per one scanning period, and the respective light power controls according to APC are completed once in 48 scanning periods.

The APC sequence of the image forming apparatus is set so that light power control is continuously executed on at least two light-emitting points in which the same light power is set as a target light power as shown in FIG. 8A to FIG. 8D. For example, as shown in FIG. 8A, the CPU 401 executes the third light power control on the light-emitting points 301 to 308 in the N+1 scanning period. Also, the CPU 401 executes the first light power control on the light-emitting points 301 to 308 in the N+2 scanning period. Further, the CPU 401 executes the second light power control on the light-emitting points 301 to 308 in the N+2 scanning period.

Figure 9:
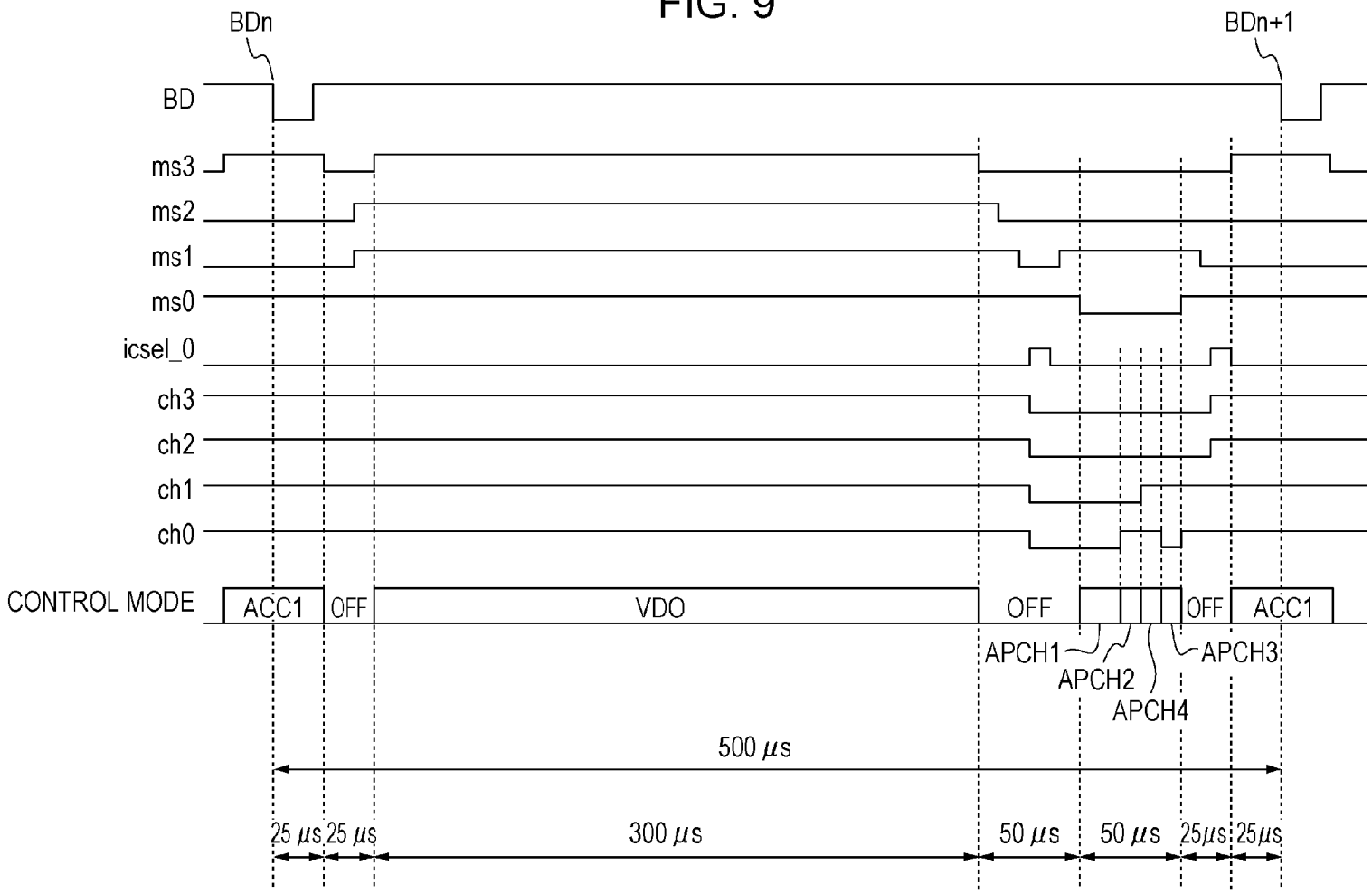
FIG. 9 is a timing chart of a scanning period.

FIG. 9 is a timing chart showing the N scanning period in the image forming apparatus in which the APC sequence shown in FIG. 8B is set. It is assumed that one scanning period is 500 μsec.

As shown in FIG. 9, the CPU 401 controls the light-emitting point 301 in ACC mode (ACC1: 50 μsec) so that laser light from the light-emitting point 301 is incident on the BD 210. By setting the light-emitting point 301 in ACC mode, a BD signal BDn is generated at a timing shown in FIG. 9. Then, the CPU 401 controls the light-emitting points 301 to 316 in OFF mode (25 μsec), and then controls the light-emitting points 301 to 316 in VDO mode (300 μsec). After VDO mode, the CPU 401 controls the light-emitting points 301 to 316 in OFF mode (50 μsec).

Then, the CPU 401 provides the third light power control on the light-emitting point 301, light-emitting point 302, light-emitting point 304, and light-emitting point 303 in that order. At this time, the mode channel decoder 633 outputs the APC mode signals which become at H level in the order of APCH_ON1, APCH_ON2, APCH_ON4, and APCH_ON3 based on the mode select signal and the channel select signal output from the CPU 401 shown in FIG. 9.

The output time of APCH_ON1 is longer than the output times of the APCH_ON2, APCH_ON4, and APCH_ON3. This is because, since the third light power control on the light-emitting point 301 is executed first in the series of light power controls, the time, in which the output of the PD 204 receiving laser light from the light-emitting point 301 is unstable, is relatively long. With regard to that the time in which the output from the PD 204 is unstable is relatively long, the image forming apparatus of this embodiment is designed so that the time of light power control which is executed first on a light-emitting point in the series of light power controls is longer than the time of the light power control which is executed next on a light-emitting point. In the image forming apparatus of this embodiment, the output time of APCH_ON1 is set at 20 μsec, and the output time of APCH_ON2, APCH_ON4, and APCH_ON3 is set at 9 μsec. The output time of the APC mode signal is set so that the series of light power controls is ended in 50 μsec.

After execution of APC, the CPU 401 generates a BD signal BDn+1 by controlling the light-emitting points 301 to 316 to OFF mode (25 μsec) and then controlling the light-emitting point 301 in ACC mode again.

Figure 10A:
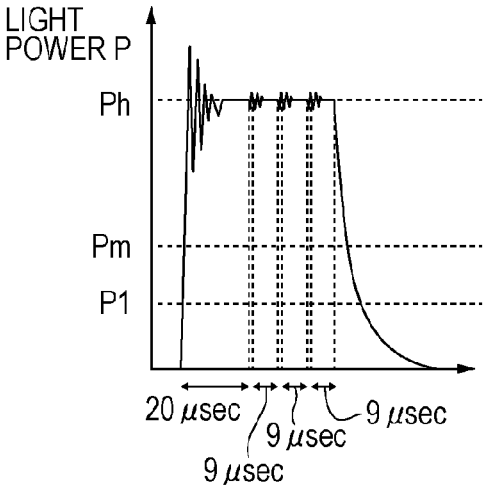
FIGS. 10A to 10C are illustrations each showing a change with time of the output signal of a PD 204 in an APC sequence.
Figure 10B:
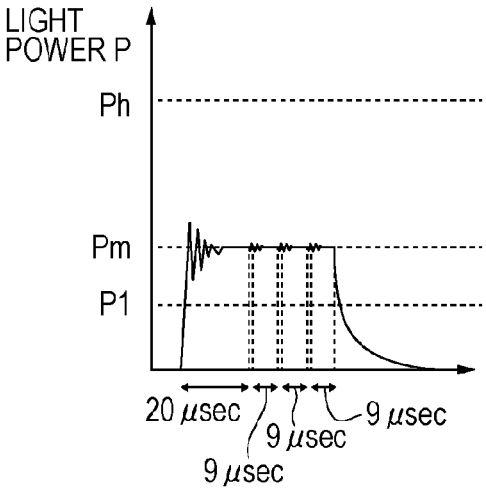
Figure 10C:
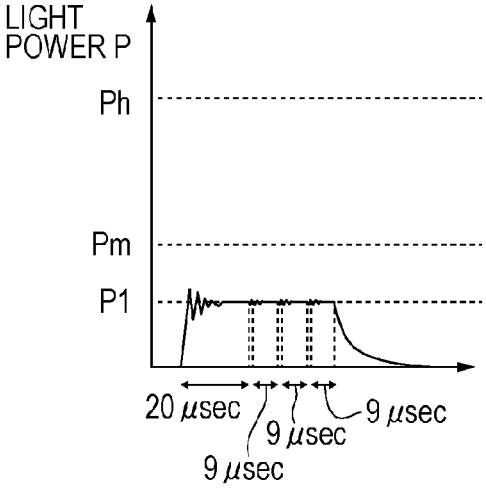

FIGS. 10A to 10C are illustrations each showing a change with time of the output signal of the PD 204 in the APC sequence shown in FIG. 8B. The vertical axis in any of FIGS. 10A to 10C plots the output (mV) of the PD 204, and the horizontal axis plots the time (μsec). FIG. 10A shows a change with time of the output signal of the PD 204 when the third light power control is executed on the light-emitting points 301 to 304 in the N scanning period. FIG. 10B shows a change with time of the output signal of the PD 204 when the first light power control is executed on the light-emitting points 301 to 304 in the N+1 scanning period. FIG. 10C shows a change with time of the output signal of the PD 204 when the second light power control is executed on the light-emitting points 301 to 304 in the N+2 scanning period.

As shown in FIG. 10A, FIG. 10B, and FIG. 10C, immediately after the laser driver 405A starts the third light power control, first light power control, and second light power control on the light-emitting point 301, since the output of the PD 204 rises from zero, it takes a time until the amplitude of the output signal of the PD 204 is decreased and the output signal becomes stable. However, in each scanning period, since the light power control with the same target light power as the target light power of the light power control on the light-emitting point 301 is executed on the light-emitting point 302 in the same scanning period, the period with an amplitude of the output signal of the PD 204 when the PD 204 receives laser light from the light-emitting point 302 is short as shown in FIGS. 10A to 10C. In this way, by continuously executing the light power control with the same target light power on a plurality of light-emitting points, the image forming apparatus of this embodiment can reduce the time required until completion of the light power control per one-time light power control to 9 μs. If it is assumed that the light-off time between light power controls for each light source is 0.1 μs, the four-time light power controls with the same target light power can be executed within the APC execution period of 50 μs available for one-time scanning in the image forming apparatus of this embodiment as shown in the following expression.

$$20\ \mu\text{sec}(\text{light power control time of light source } 301)+\{0.1\ \mu\text{s}(\text{light-off period})+9\ \mu\text{s}(\text{light power control of light sources } 302 \text{ to } 304)\}\times 3<50\ \mu\text{sec} \quad \text{Expression (1)}$$

Figure 11A:
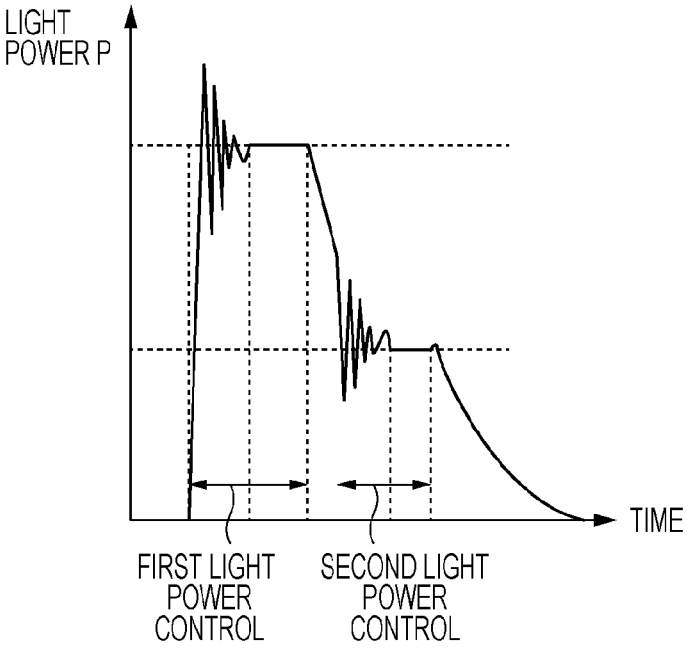
FIGS. 11A and 11B are illustrations each showing a change with time of the output signal of the PD 204 in an APC sequence of related art (comparative example).
Figure 11B:
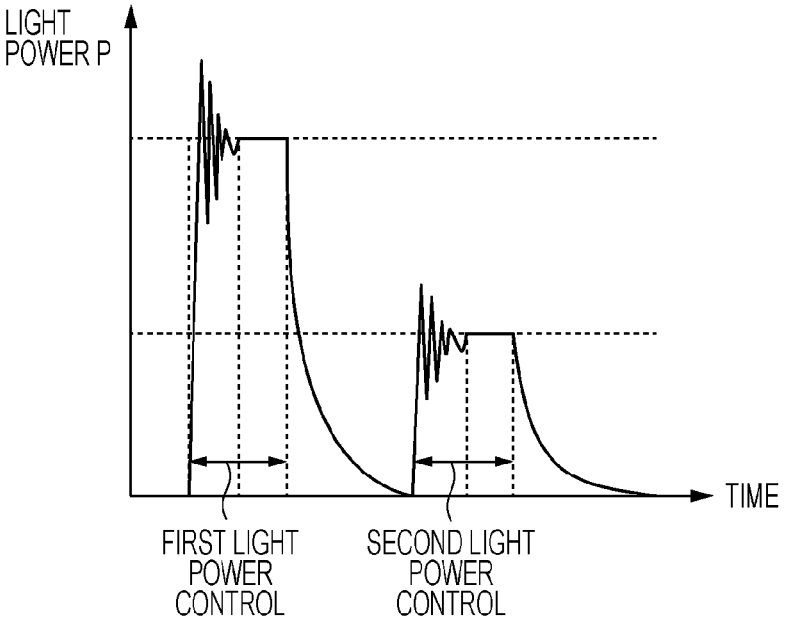

As a comparative example, FIGS. 11A and 11B each show a time required for APC execution in an APC sequence in which light power control with the same target light power is not continuously executed. FIG. 11A shows a detection signal of a PD in an APC sequence in which light power control on the light source 302 is started after light power control on the light source 301 is completed and before the output of the PD is converged to zero. In contrast, FIG. 11B shows a detection signal of the PD in an APC sequence in which light power control on the light source 302 is started after light power control on the light source 301 is completed and after the output of the PD is converged to zero.

In either case of FIG. 11A and FIG. 11B, a time is required for convergence of the detection signal output from the PD when the light power control is executed on the light source 302. Accordingly, it is found that the APC sequence in which the light power control with the same target light power is not continuously executed takes a longer time for completion of light power control on a single light source, as compared with the APC sequence in the image forming apparatus of this embodiment.

The APC sequence in the image forming apparatus of this embodiment is not limited to the patterns in FIG. 8A to FIG. 8D, and may be other sequence pattern as long as the pattern has a sequence in which light power control with the same target light power is continuously executed. For example, in the N scanning period, the first light power control may be continuously executed on the light-emitting points 301 and 302, and then the second light power control may be executed on the light-emitting points 303 and 304 in the N scanning period.

Also, the APC sequence is desirably an optimal APC sequence based on the configuration of the optical scanning device. For example, there is an image forming apparatus, in which, in a period other than the period of scanning on the photosensitive drum within one scanning period, laser light reflected by a polygonal mirror in a certain rotation phase is reflected by an inner wall of the optical scanning device and reaches the photosensitive drum. In such an image forming apparatus, the execution time of APC has to be short in a period other than the period of scanning on the photosensitive drum within one scanning period, a designer sets an APC sequence with a small number of light-emitting points on which the light power control of APC is executed within one scanning period as shown in FIG. 8D.

As described above, regarding the light power control of APC, the image forming apparatus of this embodiment decreases the time required for the light power control by continuously executing the light power control with the same target light power on at least two light-emitting points. Accordingly, the number of light-emitting points on which the light power control can be executed within one scanning period can be increased as compared with the image forming apparatus that continuously executes light power control with different target light powers. A decrease in frequency of execution of APC on respective light-emitting points can be restricted.

In the image forming apparatus that forms an image on the photosensitive member by using the light beams emitted from the plurality of light-emitting points, by continuously executing the light power control with the same target light power on different light-emitting points, a decrease in frequency of execution of the light power control on the plurality of light-emitting points can be restricted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2013/067218, filed Jun. 24, 2013, which is hereby incorporated by reference herein in its entirety.

The invention claimed is:

1. An image forming apparatus, comprising:

a photosensitive member;

a laser source including a plurality of laser-emitting points that emit light beams for exposing the photosensitive member;

a laser-receiving unit configured to receive the laser beams emitted from the plurality of laser-emitting points;

a first driver IC configured to derive a first group of the laser-emitting points;

a second driver IC configured to drive a second group of the laser-emitting points, wherein the laser-emitting points included in the second group are different from the laser-emitting points included in the first group;

a laser power control unit configured to cause the first driving IC to execute first laser power control controlling driving current supplied to each of the first group of the laser-emitting points, so that a laser power of each of the laser beams emitted from the first group of laser-emitting points and received by the laser-receiving unit becomes a first laser power, configured to cause the first driving IC to execute second laser power control controlling the driving current supplied to each of the plurality of laser-emitting points, so that the laser power of each of the laser beams emitted from the plurality of laser-emitting points and received by the laser-receiving unit becomes a second laser power, configured to cause the second driving IC to execute third laser power control controlling driving current supplied to each of the second group of the laser-emitting points so that a laser power of each of the laser beams emitted from the second group of laser-emitting points and received by the laser-receiving unit becomes the first laser power, configured to cause the second driving IC to execute fourth laser power control controlling the driving current supplied to each of the second group of the laser-emitting points so that the laser power of each of the laser beams emitted from the second group of the laser-emitting points, configured to cause the first driving IC or the second driving IC to execute any one of the first laser power control, the second laser power control, the third laser power control, and the fourth laser power control during a non-image formation period included in a period after the synchronization signal generating unit has generated one synchronization signal and before the synchronization signal generating unit generates next synchronization signal, the laser beams do not scan on the photosensitive member in the non-image formation period; and a bias current control unit configured to control a value of bias current supplied to each of the plurality of laser-emitting points based on results of the first laser power control and the second laser power control corresponding to each of the plurality of laser-emitting points.

* * * * *